United States Patent [19]

Manoogian, Jr.

[11] Patent Number: 5,072,551

[45] Date of Patent: Dec. 17, 1991

[54] GUTTER GUARD

[76] Inventor: Sarkis Manoogian, Jr., 8366 Fairview Rd., Elkins Park, Pa. 19117

[21] Appl. No.: 644,494

[22] Filed: Jan. 23, 1991

[51] Int. Cl.[5] ..... E04D 13/00

[52] U.S. Cl. ..... 52/12; 210/474; 210/232

[58] Field of Search ..... 52/12; 210/474, 232, 210/477

[56] References Cited

U.S. PATENT DOCUMENTS

| | | | |
|---|---|---|---|
| 2,209,741 | 7/1940 | Sullivan et al. . | |
| 2,219,953 | 10/1940 | Fry . | |
| 2,229,381 | 1/1941 | Grow . | |
| 2,271,081 | 1/1942 | Layton . | |
| 2,669,950 | 2/1954 | Bartholomew . | |
| 2,672,832 | 3/1954 | Goetz . | |
| 2,674,961 | 4/1954 | Lake . | |
| 3,080,682 | 3/1963 | Teutsch . | |
| 3,388,555 | 6/1968 | Foster . | |
| 4,404,775 | 9/1983 | Demartini . | |
| 4,435,925 | 3/1984 | Jefferys . | |
| 4,450,654 | 5/1984 | Clendenin . | |
| 4,455,791 | 6/1984 | Elko et al. | 52/12 |
| 4,493,588 | 1/1985 | Duffy . | |
| 4,497,146 | 2/1985 | Demartini . | |
| 4,553,356 | 11/1985 | Pepper . | |
| 4,604,837 | 8/1986 | Beam . | |
| 4,607,465 | 8/1986 | Hopkins . | |
| 4,644,704 | 2/1987 | Pedgonay . | |
| 4,667,448 | 5/1987 | Smith . | |
| 4,745,710 | 5/1988 | Davis . | |
| 4,757,649 | 7/1988 | Vahldieck . | |
| 4,858,396 | 8/1989 | Rose et al. . | |
| 4,866,890 | 9/1989 | Otto . | |
| 4,876,827 | 10/1989 | Williams . | |
| 4,937,986 | 7/1990 | Way, Sr. et al. | 52/12 |
| 4,941,299 | 7/1990 | Sweers | 52/12 |
| 4,959,932 | 10/1990 | Pfeifer | 52/12 |
| 4,965,969 | 10/1990 | Antenen | 52/12 |

*Primary Examiner*—David A. Scherbel
*Assistant Examiner*—Lan Mai
*Attorney, Agent, or Firm*—David J. Johns

[57] ABSTRACT

The present invention is an apparatus for covering traditionally mounted rain gutters. It is comprised of a roof attached shield and an arcuate screen attached to the gutter. In the preferred embodiment, a narrow trough is provided at the lower edge of the screen to accumulate excess water. The apparatus acts to separate water from debris, directing water from the roof into the gutter while encouraging the debris either to be immediately shed from the roof or to be collected and readily dried and removed from the trough.

19 Claims, 2 Drawing Sheets

GUTTER GUARD

BACKGROUND OF THE INVENTION

1. Field of the Invention

The present invention relates to apparatus for covering rain gutters, directing rain water from a sloping building roof into the gutter while protecting the gutter from accumulation of leaves and debris.

2. Description of the Prior Art.

Rain gutters are customarily provided adjacent to a sloping roof of a building. Typically they are comprised of a trough shaped horizontal section running along the edge of the roof and a vertical downpipe. Common problems associated with rain gutters are that leaves and debris pile up and clog them, and that water travelling down a sloping roof might gather enough momentum to overcome surface adhesion force and flow over the outer edge of the gutter and down the building wall instead of into the gutter.

Presently, the debris accumulation problem has been attempted to be solved by a variety of means. A number of patents, such as U.S. Pat. Nos. 2,219,953, 4,553,356, 4,644,704, and 4,907,381, attempt to solve this problem by covering the gutter with a screen or a mesh guard. These devices are in wide-spread use today, due in no small part to their relatively low price and ease in installation. Unfortunately this approach has proven to be less than acceptable since leaves and debris continues to pile up on the screen surface thus blocking access of water to the gutter.

Another approach to attempt to separate debris from water is addressed in a number of patents which employ the surface tension of the water along a solid arcuate member to direct only water into the gutter. Devices of this nature are disclosed in U.S. Pat. Nos. 4,404,775, 4,607,465 and 4,866,890. One of the primary problems created by deflector-type gutter guards are that they are usually bulky and are often difficult to install. Generally, these devices require the gutter to be replaced, or repositioned or modified to accommodate the curve of the arcuate member. These devices are also deficient in that their water carrying capacity is limited, depending in large part on the radius of the arcuate member, which often results in overflow in heavy rain storms. Finally, leaves continue to be a problem by sticking to the solid deflector surfaces, lessening surface adhesion force and again leading to the gutter overflow problems, and by being inadequately screened from the gutter, especially as the arc of the gutter is increased to increase the water carrying capacity.

Accordingly, it is a primary object of the present invention to provide a gutter guard which effectively separates leaves and other debris from rainwater entering a gutter, while requiring minimum maintenance.

It is a further object of the present invention to provide such a gutter guard which is relatively inexpensive to manufacturer and which may be readily installed on existing gutters without modification.

It is an additional object of the present invention to provide such a gutter guard which employs an arcuate surface to separate debris, but includes means to assure that water is always directed into the gutter even in heavy rain storms.

These and other objects of the present invention will become evident upon review of the following description of the present invention.

SUMMARY OF THE INVENTION

The present invention provides an apparatus for covering rain gutters. It comprises a shield attached to a pitched roof, providing a surface of a lesser incline than that of the roof, and an arcuate screen attached to the lower edge of the shield. The radius of the screen is great enough to cause the separation of debris from water, but not so great that the screen extends beyond the front wall of the gutter. The lower edge of the screen forms a trough shaped lip that attaches to the front wall of the gutter.

In operation, rain water flows off the roof onto the shield, and then into the gutter through the arcuate screen. Leaves and debris are prevented from accumulating on the screen by its arcuate shape and are blown off the roof either immediately upon separating from the water, or after accumulating in the trough shaped lip and being dried. Overflow in excessively heavy rains is avoided by the extra water carrying and straining capacity of the trough in the lower portion of the screen.

The angle formed between the shield and the roof permits the apparatus to be installed on a conventionally mounted gutter without the need of reinstalling the gutter lower down the building wall. Employing both roof and gutter anchoring means, the present invention may be readily installed on any commercially available gutter.

DESCRIPTION OF THE DRAWINGS

The operation of the present invention should become apparent from the following description when considered in conjunction with the accompanying drawings, in which.

DETAILED DESCRIPTION OF THE INVENTION

Figure 1:
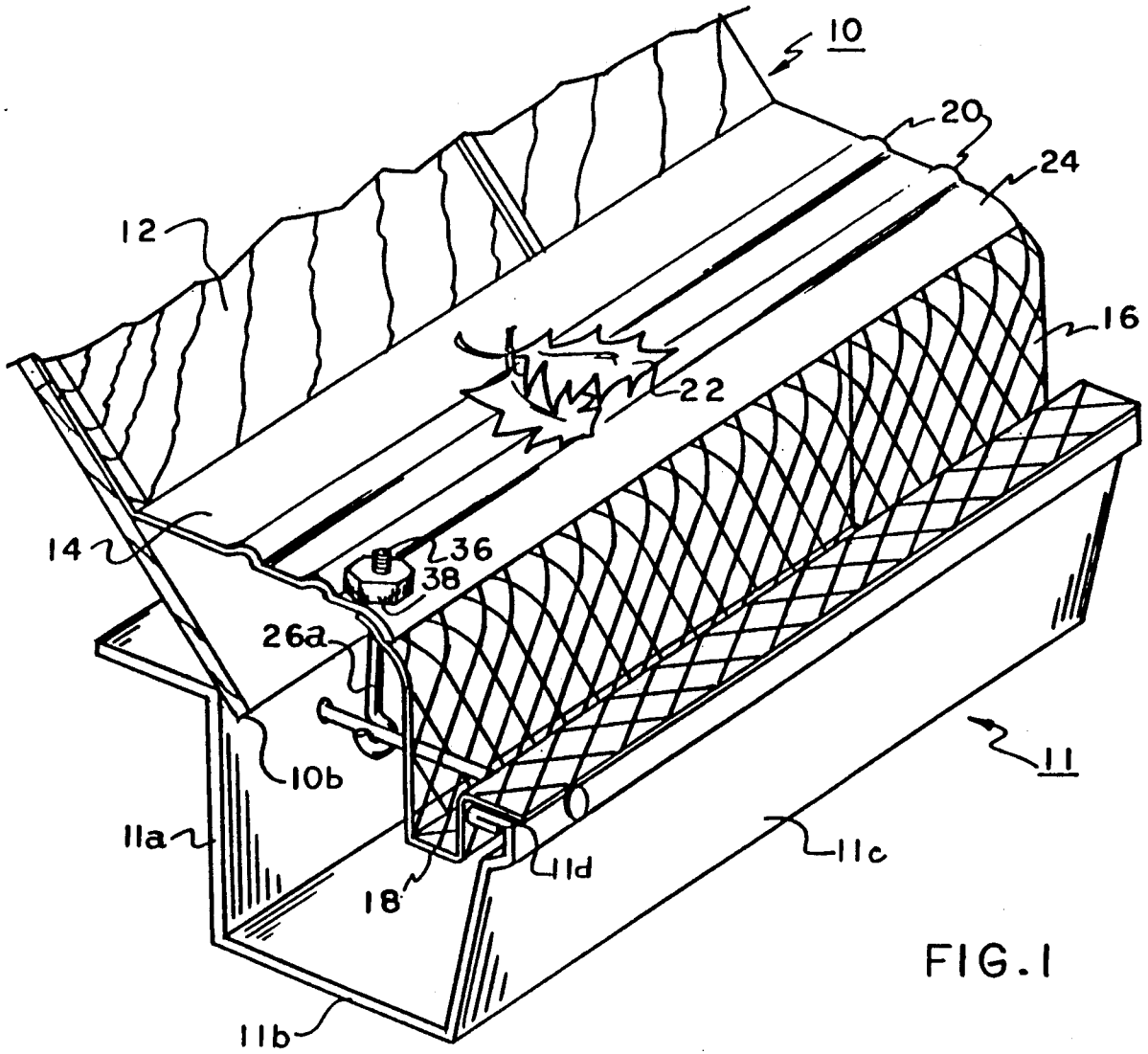
FIG. 1 is a perspective view of an embodiment of the present invention.

Referring to FIG. 1, the apparatus 10 of the present invention is shown in an assembly with a conventional gutter 11 installed directly below an edge 10*b* of a sloping roof 12. As is known, the gutter 11 comprises a back wall 11*a*, a bottom surface 11*b*, front wall 11*c*, and a top edge 11*d*.

The present invention comprises a shield portion 14, attached to the roof 12, and an arcuate screen 16, terminating in trough 18 attached to the gutter 11. The shield 14 provides a surface of lesser incline than that of the roof 12, thus decreasing the velocity of water coming from the roof and preventing it from flowing over the edge of the gutter 11 instead of into it. In the illustrated preferred embodiment of the present invention, the velocity of water may be decreased even further by flow control means 20, such as texturing of the surface of the shield 14, to provide further braking friction for the water exiting the roof. The flow control means illustrated comprise speed bumps 20, molded or welded into the surface of the shield 14.

In order to decrease the speed of the water exiting the gutter to the greatest degree possible, it is desirable that the slope of the shield 14 be as close to horizonal as possible. However, it should be appreciated that standing water should be avoided and that the shield and the flow control means 20 thereon should be oriented so that water will readily drained therefrom. This may be accomplished by any convenient manner, such as providing a slight slope to the shield 14, providing regular channels through the speed bumps 20, and/or providing periodic drain holes in the shield which will permit standing water to flow through to the roof 12 underneath the shield and into the gutter 11.

Figures 2, 3:
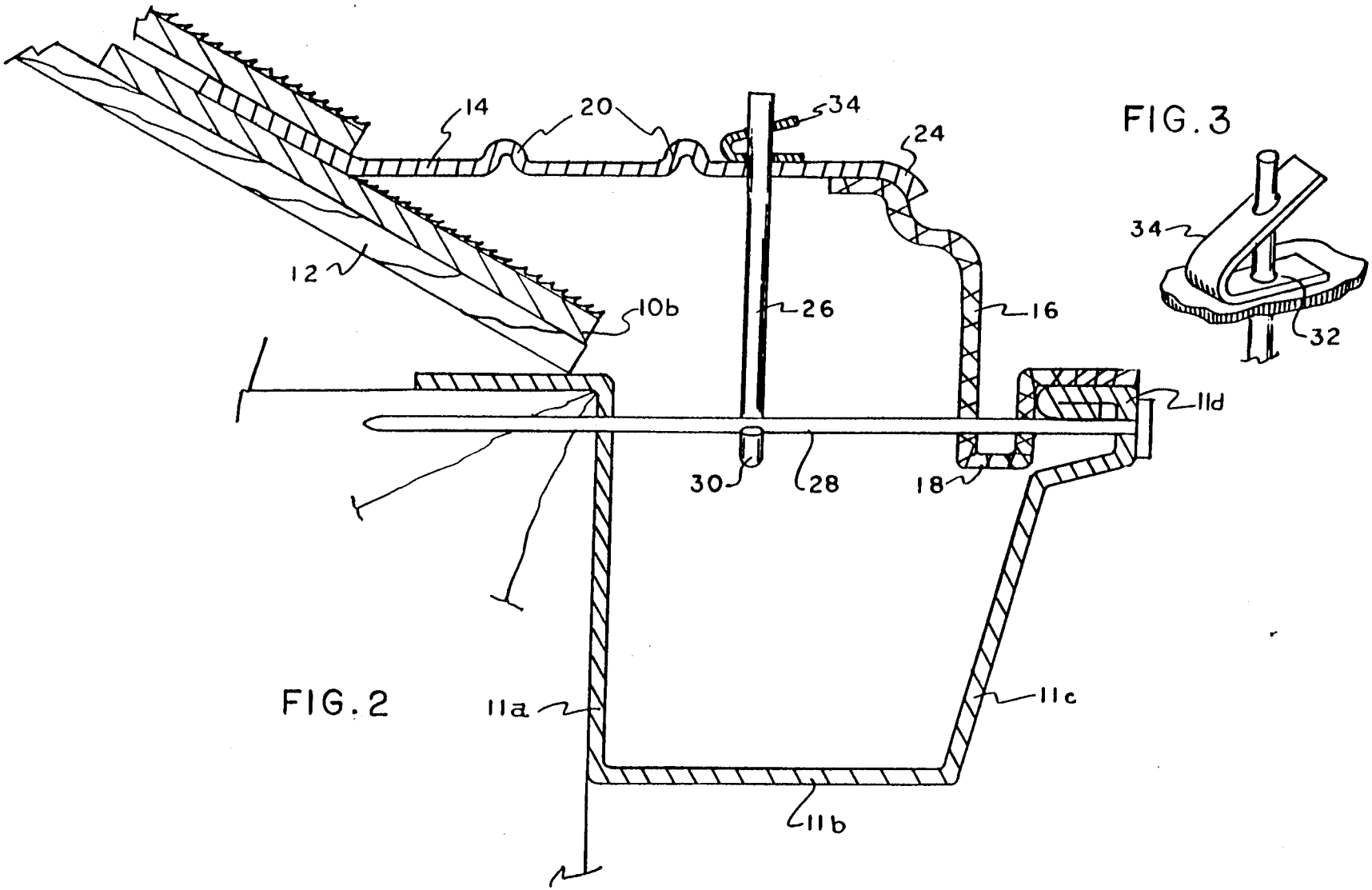
FIG. 2 is a cross-sectional view of an embodiment of the present invention.
FIG. 3 is an enlarged perspective view of a spring clip and lanyard shown in FIG. 2.

As can be seen in FIGS. 1 and 2, the arcuate screen 16 is attached at its upper most edge to the lower edge of the shield 14. The arc of the screen 16 is such that the trough 18 of the screen is positioned behind the front wall 11*c* of the gutter 11. When debris 22, such as a leaf or seed, is swept down the shield 14, the screen 16 segregates rain water from the debris 22 through the known surface tension of the water which will cause it to adhere to the arc of the screen 16 and enter the gutter 11 through the screen 16 either in the arc or in the trough 18. As is known, debris 22 will tend not to adhere to an arcuate surface and will either continue travelling tangentially to the arc over the front wall 11*c* of the gutter 11 or, to a much lesser degree, to accumulate in the trough 18 at the lowermost edge of the screen 16 and adjacent to the front wall of the gutter 11.

The trough 18 should be constructed with a narrow enough width that any leaves collected therein will be forced into a vertical position, which will permit them to be dried and subsequently blown off the roof or easily removed from the trough 18. In this regard, it is believed that the trough 18 should be of a width of approximately 1 to 5 cms. It should be understood that a wider trough 18 has greater water carrying capacity, but also provides a larger area to trap debris 22 and is less effective at drying debris 22 trapped therein.

The water collection capacity of the present invention may be further enhanced by providing an arcuate lip 24 at the lower end of the shield 14. This lip 24 serves to further direct the water downward into the screen 16 and to provide a further arc which assists in the separation of the debris 22 from the water.

As is shown in FIGS. 2 and 3, the apparatus 10 may be fastened to the gutter 11 by attaching one or more lanyards 26 to conventional studs 28 used to anchor the gutter 11 in place. In the preferred embodiment shown in FIG. 2, the lanyard 26 is attached to the stud 28 by a hook 30, which engages the stud 28. The lanyard 26 then is passed up through an opening 32 in the shield 14. The lanyard 26 may then be held in place through any conventional means, including a spring clip 34 or a lock ring (not shown). In this manner, the lanyard 26 may be pulled up tight and then held in place to provide a snug fit between the apparatus 10 and the gutter 11.

Another embodiment of the fastening means is shown in FIG. 1. The lanyard 26*a* in that embodiment has a threaded end 36 which may be held in place with a nut 38. The nut 38 may be tightened to hold the lanyard snugly in place. Other means of fastening the apparatus 10 to the gutter 11 include attaching the shield 14 to the roof 12 with nails, screws, staples or other known means, and/or attaching the screen 16 to the front wall 11*c* of the gutter 11 by clips or threaded attachments.

It should be appreciated that the apparatus 10 of the present invention may be constructed from any suitable material. In the preferred embodiment, the screen 16 and the shield 14 are fabricated from a rust-proof metal alloy or weather-resistant plastic. For ease in manufacture, it is preferred that the shield 14 and screen 16 be constructed from a single unit, such as through the use of plastic or aluminum on galvanized steel. Since the shape of the arc of the screen 16 must be maintained for best operation of the present invention, it is particularly desirable that a material be employed which will resist any serious distortion of the curve. This may be accomplished through a rigid screen material and/or the use of rigid braces affixed to the screen to maintain its shape. The screen 16 should have a mesh density of at least 4 holes per square inch, and preferably a density of 6 to 12 holes per square inch.

The advantages of the present invention are manifold. First, the use of an arcuate surface which also permits water to enter the gutter 11 throughout the length of the arc provides the separation advantages of previous arc-deflectors without the space requirement of a full semi-circular arc. As is shown, this permits the present invention to be employed with conventional gutters without the need to move or modify the gutters. Another advantage over other available arc-deflectors is that the existence of a trough 18 at the base of the screen 16 provides means to assure that water will not simply overflow the gutter when the quantity and/or velocity of the water exceeds the capacity of the arc to redirect the water.

Although particular embodiments of the present invention are disclosed herein, it is not intended to limit the invention to such a disclosure and changes and modifications may be incorporated and embodied within the scope of the following claims.

What is claimed is:

1. An apparatus for covering a traditionally mounted roof gutter, the gutter attached directly adjacent to and below an edge of a roof, to prevent the accumulation of leaves and debris in the gutter, the gutter providing a conduit for the run-off of water through the combination of a back wall, a bottom surface, a front wall, and a top edge at the upper most end of the front wall, which apparatus comprises:

a shield which is attached to a pitched roof in a position spaced above and behind the roof's edge, the shield providing a surface of lesser incline than that of the roof so to low the velocity of water leaving the roof;

an arcuate screen portion attached at one end to the shield adjacent to its lowermost edge and at the other end to the front wall of the gutter, the screen having a radius which does not extend beyond a plane drawn vertically from the front wall of the gutter, the arc of the screen being sufficient to direct water leaving the shield downward into the gutter, the water entering the gutter through the screen, while allowing leaves and debris to be shed over the front wall of the gutter; and wherein the screen provides a trough at its lowermost edge behind the front wall of the gutter and extending below then top edge of the gutter to collect and strain water which fails to enter the gutter through the arc of the screen, the trough being of a cross-sectional width which is narrow enough the any leaves which may become trapped therein will be held in a substantially vertical position to promote their drying, while being of a cross-sectional width great enough that leaves and debris trapped therein may be easily removed.

2. The apparatus of claim 1 wherein an arcuate lip is provided at the edge of the shield attached to the screen, the arc of the lip being sufficient to direct water leaving the shield downward into the gutter through the screen.

3. The apparatus of claim 1 wherein the shield is provided with a surface texture which assists in decreasing the velocity of the water leaving the roof.

4. The apparatus of claim 3 wherein the surface texture includes ridges oriented substantially perpendicular to the flow of the water from the roof.

5. The apparatus of claim 1 wherein means are included to anchor the apparatus in place.

6. The apparatus of claim 5 wherein the means to anchor the apparatus in place includes a lanyard which attaches between the apparatus and a conventional stud used to anchor a gutter in place.

7. The apparatus of claim 6 wherein the lanyard attaches to the stud intermediate its ends, and means are included to attach the lanyard adjustably to the shield.

8. The apparatus of claim 7 wherein the means to attach the lanyard adjustably to the shield comprises an adjustable locking clip adapted to fit around the lanyard and hold it in place;

a hole in the shield through which the lanyard may be passed;

the combination of the clip and the shield serving to retain on the lanyard and to assist in retaining the apparatus against the gutter.

9. The apparatus of claim 5 wherein the means to anchor the apparatus in place includes affixing the shield of the roof.

10. The apparatus of claim 9 wherein the shield is affixed to the roof by nails passing through the shield into the roof.

11. The apparatus of claim 1 wherein the incline of the shield is substantially level.

12. The apparatus of claim 1 wherein the screen is provided with a mesh of a density of 4 to 12 holes per square inch.

13. An apparatus for covering a traditionally mounted roof gutter, the gutter attached directly adjacent to and below an edge of a roof, to prevent the accumulation of leaves and debris in the gutter, the gutter providing a conduit for the run-off of water through the combination of a back wall, a bottom surface, and a front wall, and the gutter including a top edge at the upper most end of its front wall, which apparatus comprises:

a shield which is attached to a roof in a position spaced above and behind the roof's edge, the shield providing a surface of lesser incline than that of the roof so to slow the velocity of water leaving the roof;

an arcuate lip at the lowermost edge of the shield;

an arcuate screen portion attached to the shield adjacent to the lip at one end and to the front wall of the gutter at the other end, the screen having a radius which does not extend beyond a plane drawn vertically from the front wall of the gutter;

the arc of the lip and the arc of the screen each being sufficient to direct water leaving the shield downward into the gutter, the water entering the gutter through the screen;

the screen providing a trough at its lowermost edge positioned behind the front wall of the gutter and which extends below the top edge of the gutter to collect and strain water into the gutter which fails to enter the gutter through the arc of the screen, the trough being of a cross-sectional width which is narrow enough that any leaves which may become trapped therein will be held in a substantially vertical position, which will promote their drying, while being of a cross-sectional width great enough to provide ease in removing leaves trapped therein.

14. The apparatus of claim 13 wherein the shield is provided with surface texture which assists in decreasing the velocity of the water leaving the roof.

15. The apparatus of claim 14 wherein the surface texture includes ridges oriented substantially perpendicular to the flow of the water from the roof.

16. The apparatus of claim 13 wherein the apparatus is anchored in place by a lanyard which attaches between the shield and a conventional stud used to anchor a gutter in place.

17. The apparatus of claim 16 wherein the lanyard is attached adjustably to the shield by providing a threaded end on the lanyard which passes through the shield, and a nut which attaches to the threaded end of the lanyard to hold it in place.

18. The apparatus of claim 16 wherein the lanyard is adjustably attached to the shield by an adjustable locking clip adapted to fit around the lanyard and hold it in place;

a hole in the shield through which the lanyard may be passed;

the combination of the clip and the shield serving to retain tension on the lanyard and to assist in retaining the apparatus against the gutter.

19. The apparatus of claim 13 wherein the apparatus is anchored in place by nailing the shield to the roof.

* * * * *

UNITED STATES PATENT AND TRADEMARK OFFICE

CERTIFICATE OF CORRECTION

PATENT NO. : 5,072,551

DATED : December 17, 1991

INVENTOR(S) : Sarkis Manoogian, Jr.

It is certified that error appears in the above-identified patent and that said Letters Patent is hereby corrected as shown below:

Column 4 line 61 "the" should be --that--.

Signed and Sealed this

Ninth Day of March, 1993

*Attest:*

STEPHEN G. KUNIN

*Attesting Officer*

*Acting Commissioner of Patents and Trademarks*